US008851088B2

(12) United States Patent
Dibnah et al.

(10) Patent No.: US 8,851,088 B2
(45) Date of Patent: Oct. 7, 2014

(54) RECEPTACLE FOR PERSONAL CARE COMPOSITION

(75) Inventors: Carl Dibnah, Hull (GB); Christopher Leonard Padain, Montvale, NJ (US); Thomas Edward Walker, Bristol (GB); Craig Ian Wightman, Bristol (GB)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 419 days.

(21) Appl. No.: 12/740,744

(22) PCT Filed: Oct. 22, 2008

(86) PCT No.: PCT/GB2008/003552

§ 371 (c)(1),
(2), (4) Date: Oct. 28, 2010

(87) PCT Pub. No.: WO2009/056795

PCT Pub. Date: May 7, 2009

(65) Prior Publication Data

US 2011/0042378 A1 Feb. 24, 2011

(30) Foreign Application Priority Data

Nov. 1, 2007 (GB) ..... 0721479.4

(51) Int. Cl.
*A45D 33/24* (2006.01)
*A45D 33/26* (2006.01)
*A45D 26/00* (2006.01)

(52) U.S. Cl.
CPC ..... *A45D 26/0014* (2013.01)
USPC ..... 132/294; 206/581; 132/300

(58) Field of Classification Search
CPC ..... B65D 69/00; B65D 7/04; A45D 33/00; A45D 2033/001
USPC ..... 206/581, 223, 579, 229, 210, 742, 546; 220/4.27; 132/294, 293, 300, 200; 606/132, 133; 53/443, 467, 476
See application file for complete search history.

(56) References Cited

U.S. PATENT DOCUMENTS 1,573,036 A 2/1926 Bowman
2,491,101 A * 12/1949 Freiberg ..... 132/297

(Continued)

FOREIGN PATENT DOCUMENTS

EP 1350441 10/2003

OTHER PUBLICATIONS

PCT International Search Report dated Jan. 13, 2009 for related PCT Application No. PCT/GB2008/003552.

*Primary Examiner* — Luan K Bui
*Assistant Examiner* — Rafael Ortiz
(74) *Attorney, Agent, or Firm* — Troutman Sanders LLP; Ryan A. Schneider; Elizabeth-Ann Weeks

(57) ABSTRACT

The present invention describes a receptacle (10) for a personal care composition comprising a container (12), a separate closure member (14), at least one applicator means (22) for the application of the composition to a user and at least one removal means (24) for the removal of the composition from a user, wherein: the container comprises a reservoir means for retaining a quantity of composition and an aperture (18) in an upper portion of said container; and wherein the closure member has a hollow construction and a releasably sealable lid member (16), and the interior of the closure member is configured to house the at least one applicator means and the at least one removal means; and wherein securing means (20) are provided to permit the closure member to be releasably engagable with the container to close the aperture when engaged. The present invention also describes a method of applying a personal care composition.

13 Claims, 1 Drawing Sheet

(56) References Cited

U.S. PATENT DOCUMENTS

| | | | | | |
|---|---|---|---|---|---|
| 3,485,344 | A | * | 12/1969 | Aylott | 206/784 |
| 4,165,815 | A | * | 8/1979 | Vetter | 220/4.27 |
| 4,282,877 | A | * | 8/1981 | Mathews | 606/134 |
| 4,815,608 | A | | 3/1989 | Silberberg | |
| 5,025,817 | A | * | 6/1991 | Wen | 132/296 |
| D377,757 | S | * | 2/1997 | Bertolini et al. | D9/746 |
| 7,832,564 | B2 | * | 11/2010 | Kim | 206/581 |
| 2003/0057127 | A1 | * | 3/2003 | Lambert | 206/581 |
| 2005/0166937 | A1 | * | 8/2005 | Taft | 132/73 |
| 2006/0188850 | A1 | | 8/2006 | Mills | |
| 2008/0023025 | A1 | * | 1/2008 | Burtzlaff et al. | 132/320 |
| 2008/0035495 | A1 | * | 2/2008 | Discko, Jr. | 206/209 |
| 2008/0083419 | A1 | * | 4/2008 | Glenn et al. | 132/208 |

* cited by examiner

RECEPTACLE FOR PERSONAL CARE COMPOSITION

BENEFIT CLAIMS

This application is a US National Stage of International Application No. PCT/GB2008/003552, filed 22 Oct. 2008, which claims the benefit of GB 0721479.4, filed 1 Nov. 2007.

FIELD OF THE INVENTION

The present invention relates to a receptacle for a personal care composition.

BACKGROUND

Personal care compositions can include a range of substances such as wax compositions for hair removal, depilatory compositions for hair removal, whitening compositions for lightening body parts of the user, colouring compositions for colouring body parts of the user such as their hair. These substances share a common drawback however in that a user must carefully apply such compositions as they are generally only for use on specific parts of the user and/or are generally not to be spilled as they may damage a surface on which they are not intended to be used.

To assist in the application of such personal care compositions some form of application device may be provided. However, such application devices can become detached from the packaging which would make the application of the composition difficult and/or possibly hazardous. Furthermore, when the composition is provided for multiple applications (i.e. at least two separate applications by a user, thus requiring storage of the composition in between applications) it may be problematic to ensure that the application device remains with the composition for subsequent applications of the composition.

Due to the nature of such compositions, a user may wish to have access to instructions to ensure the correct application thereof. Where instructions are printed on the side of a container of composition, this can prove hazardous should a user need to refer to the instructions whilst attempting to apply the composition. Furthermore, when the composition is provided for multiple applications it may be problematic to ensure that the instructions remains with the composition for subsequent applications of the composition.

It is an object of the present invention to address the above-mentioned concerns and disadvantages with the known prior art.

SUMMARY OF INVENTION

According to a first aspect of the present invention there is provided therefore a receptacle for a personal care composition comprising a container, a separate closure member, at least one applicator means for the application of the composition to a user and at least one removal means for the removal of the composition from a user, wherein:

the container comprises a reservoir means for retaining a quantity of composition and an aperture in an upper portion of said container;

and wherein the closure member has a hollow construction and a releasably sealable lid member, and the interior of the closure member is configured to house the at least one applicator means and the at least one removal means;

and wherein securing means are provided to permit the closure member to be releasably engagable with the container to close the aperture when engaged.

This arrangement may allow a user to separate the closure member from the container to provide easy access to the reservoir means at the same time as providing access to the interior of the closure member. Therefore, this arrangement may be advantageous as a user would, in use, have ease of access to the at least one applicator means and at least one removal means and the personal care composition, thus, ensuring a more convenient and safe transfer of the composition to the area of the user on which it is intended to be used.

Preferably the receptacle is further provided with at least one set of instructions wherein said set(s) of instructions may also be housed within the closure member.

Preferably the securing means are provided by a screw thread arrangement on the closure member and the container which are configured to be screwed into releasable engagement with each other. Alternatively the securing means may be provided by one of the closure member or the container having one or more projections and the other of the closure member or container having corresponding recesses to receive the projection(s) to permit the releasable engagement of the member and the container.

The lid member is preferably releasably sealable with an upper portion of the closure member, wherein said upper portion is remote from the container when the container and the closure member are engaged.

In an alternative arrangement the lid member is preferably releasably sealable with a lower portion of the closure member, wherein said lower portion is substantially adjacent to the container when the container and the closure member are engaged.

Preferably a minor portion of the lid is integral with or substantially permanently attached to a major portion of closure member. This may be advantageous as the user is able to gain access to the interior of the closure member but there is no likelihood that the lid will be lost or misplaced, thus, ensuring that the at least one applicator means and at least one removal means can be easily secured within the closure means for subsequent use.

Preferably the at least one applicator means and at least one removal means are removable from the closure member. The interior of the closure member may be provided with fittings to releasably retain said at least one applicator means and said at least one removal means. Preferably the at least one removal means are configured to be secured within the interior by the at least one applicator means being releasably supported by the fittings. The fittings may by configured to provide frictional grip, such as a snap-fit arrangement, or a movable clasp arrangement to secure the at least one applicator means within the interior.

The at least one removal means may take the form of waxing strips and/or hair removal scrappers or the like.

The aperture of the container is preferably dimensioned such that its width and/or breadth is equal to the height of the container. This may be advantageous as a user would be provided with ease of access to the reservoir whilst the container would retain a low centre of gravity to prevent toppling over whilst the user removes, in use, composition therefrom. Even more preferably, the aperture of the container is dimensioned such that its width and/or breadth is greater than the height of the container. Preferably the aperture is substantially circular and has a diameter that is equal to or greater than the height of the container.

The receptacle may be for multiple use; i.e. the composition that may be contained therein is for at least two separate applications by a user, thus requiring storage of the composition in the receptacle in between applications.

According to a second aspect of the present invention there is provided therefore a personal care composition and a receptacle therefor, wherein said receptacle comprises a container, a separate closure member, at least one applicator means for the application of the composition to a user and at least one removal means for the removal of the composition from a user, wherein:

the container comprises a reservoir means for retaining a quantity of composition and an aperture in an upper portion of said container;

and wherein the closure member has a hollow construction and a releasably sealable lid member, and the interior of the closure member is configured to house the at least one applicator means and the at least one removal means;

and wherein securing means are provided to permit the closure member to be releasably engagable with the container to close the aperture when engaged.

According to a third aspect of the present invention there is provided therefore a method of applying a personal care composition from a receptacle according to the second aspect of the present invention or from the receptacle according to the first aspect of the present invention when loaded with composition comprising the steps of:

separating the closure member from the container;

opening the lid member of the closure member and extracting at least one applicator and at least one removal means;

inserting the applicator through the aperture and into the reservoir to extract a quantity of composition;

using the applicator means to apply the composition to a body part of the user;

subsequently the removal means to remove the composition from the user;

replacing the at least one removal means and the at least one applicator means in the interior of the closure member and resealing the lid member; and engaging the closure member with the container to close the aperture.

BRIEF DESCRIPTION OF THE DRAWINGS

Embodiments of the invention will now be described, by way of example only, with reference to the following drawings in which.

DESCRIPTION OF AN EMBODIMENT

Figure 1:
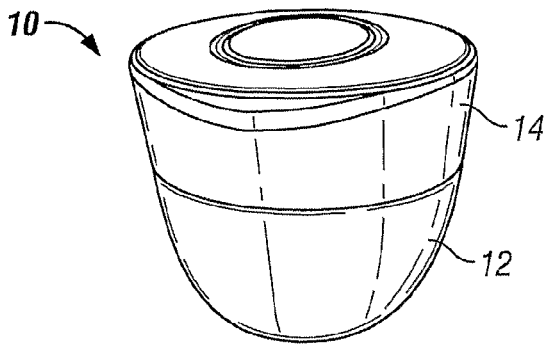
FIG. 1 illustrates a perspective view of a receptacle according to the present invention.
Figure 2:
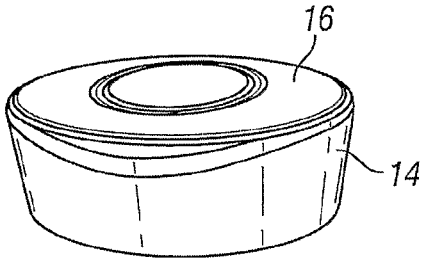
FIG. 2 illustrates a perspective view of a closure member according to the present invention.
Figure 3:
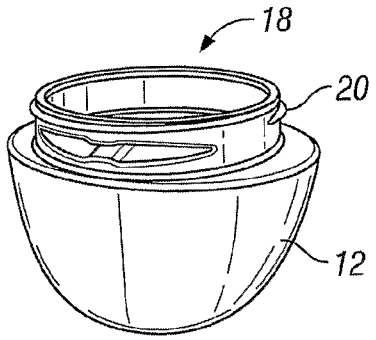
FIG. 3 illustrates a perspective view of a container according to the present invention.

With reference to FIGS. 1-3 a receptacle 10 in accordance with the present invention is illustrated. The receptacle 10 comprises a container 12 engaged with a closure member 14. The container 12 as illustrated is defined by a hollow body, a reservoir means, which is shaped to retain a quantity of personal care composition therein in use. The reservoir means possesses an aperture 18 at an upper portion thereof which permits access to the reservoir means. Beneath the aperture on the exterior surface of the container 12 are located securing means 20 which, in the embodiment illustrated, take the form of a projecting thread. This thread 20 is engagable with a corresponding thread (not shown) within the closure member 14.

The closure member 14 has a releasably sealable lid member 16 located at the upper portion thereof. In the illustrated embodiment, the lid member 16 is hinged to the main portion of the closure member 14. This could be achieved by the lid member 16 being constructed in an integral arrangement with the main portion of the closure member and having a weakened section to operate as the hinge or the lid member 16 could be made separately from the main portion of the closure member 14 and subsequently connected thereto by an suitable means, such as by welding, adhesives, snap-fit attachment, a pin/hole hinge mechanism or the like.

Figure 4:
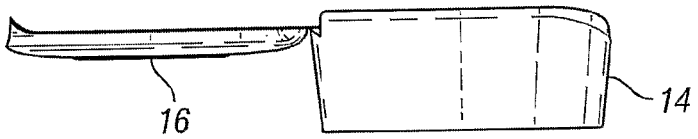
FIG. 4 illustrates a side view of the closure member shown in FIG. 5.
Figure 5:
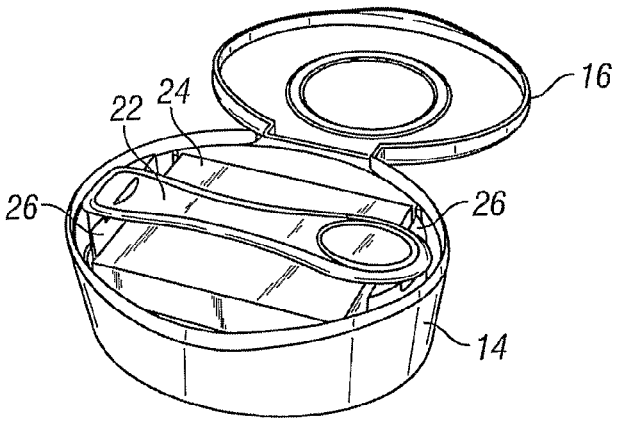
FIG. 5 illustrates a perspective view of an opened closure member according to the present invention.

Turning to FIGS. 4-5 the interior of the closure member 14 can be seen. The lid member 16 can be opened on its hinge to provide access to the interior of the closure member 14. The interior is shaped to permit at least one removal means and at least one applicator means to be stored therewithin. The applicator means is illustrated as an applicator 22 with a depression which may, in use, permit a user to better scoop up the composition. The removal means is illustrated as strip pack 24 of strips of sheet material for the removal of the applied composition.

Although not illustrated, a set of instructions may also be stored within the interior of the closure member 14.

Fittings 26 are provided in the interior of the closure member 14. In the illustrated embodiment the fittings 26 are arranged to support the applicator 22. However, the fittings may have a snap-fit connection with the applicator. This arrangement may also permit the applicator, once fitted in the fittings, to retain the at least one removal means in the interior of the closure member 14.

In use a user would separate the closure member 14 from the container 12 and place the closure member 14 on a surface nearby the container 12. The user would then open the lid member 16 and extract the applicator 22 from the fittings 26 and strip pack 24. Preferably after reading the instructions which may set out the prescribed rules of exactly how and where the user should apply the composition, the user would insert the applicator 22 through the aperture 18 and into the reservoir to extract a quantity of composition. The user would then apply the composition to a part of their body. For instance, where the composition is a hair removal wax, the user may apply the wax to their leg. The user may then take a strip from the strip pack 24 and use this to extract the hair from the leg where wax has been applied. The user may then repeat the application and removal of wax as necessary, preferably in accordance with the rules of the set of instructions. Once the user has finished applying the composition they may then replace the strip pack 24, optionally the instructions, and finally the applicator 22 in the interior of the closure member 14. As mentioned, the applicator 22 may be secured in frictional engagement with the fittings 26 thus further retaining the strip pack 24 and, optionally the instructions, in the interior. The lid member 16 may then be resealed with the main portion of the closure member 14. Finally, the threading 20 on both the closure member 14 and the container 12 is mated to releasably secure them together and to close the aperture 18, thus sealing the composition within the reservoir.

The invention claimed is:

1. A receptacle for a personal care composition comprising:

a container, a separate closure member, and at least one applicator means for the application of the composition to a user and at least one removal means for the removal of the composition from a user;

wherein the container comprises a reservoir means for retaining a quantity of composition and an aperture in an upper portion of said container;

wherein the closure member has a hollow construction and a releasably sealable lid member, the interior of the closure member being configured to house the at least one applicator means and the at least one removal means, and the interior of the closure member being provided with fittings to releasably support at least one of said at least one applicator means and said at least one removal means, wherein the at least one removal means is configured to be secured within the interior by the at least one applicator means being releasably retained by the fittings;

wherein the at least one applicator means and the at least one removal means are removable from the closure member; and wherein securing means are provided to permit the closure member to be releasably engagable with the container to close the aperture when engaged.

2. The receptacle according to claim 1, wherein the lid member is releasably sealable with an upper portion of the closure member, and wherein said upper portion is remote from the container when the container and the closure member are engaged.

3. The receptacle according to claim 1, wherein the lid member is releasably sealable with a lower portion of the closure member, and wherein said lower portion is substantially adjacent to the container when the container and the closure member are engaged.

4. The receptacle according to claim 1, wherein a minor portion of the lid is integral with or substantially permanently attached to the closure member.

5. The receptacle according to claim 1, wherein the at least one applicator means and at least one removal means are removable from the closure member.

6. The receptacle according to claim 1, wherein the fittings are configured to provide frictional grip.

7. The receptacle according to claim 1, wherein the aperture of the container is dimensioned such that at least one of its width and breadth is equal to the height of the container.

8. The receptacle according to claim 1, wherein the aperture of the container is dimensioned such that its width and/or breadth is greater than the height of the container.

9. The receptacle according to claim 1, wherein the aperture is substantially circular and has a diameter that is equal to or greater than the height of the container.

10. The receptacle according to claim 1, wherein the receptacle is for multiple use.

11. The receptacle of claim 1, wherein the removal means comprises waxing strips or hair scrapers.

12. A personal care composition and a receptacle therefor, wherein said receptacle comprises a container, a separate closure member, at least one applicator means for the application of the composition to a user and at least one removal means for the removal of the composition from a user, wherein:

the container comprises a reservoir means for retaining a quantity of composition and an aperture in an upper portion of said container;

wherein the closure member has a hollow construction and a releasably sealable lid member, the interior of the closure member being configured to house the at least one applicator means and the at least one removal means, and the interior of the closure member being provided with fittings to releasably support at least one of said at least one applicator means and said at least one removal means, wherein the at least one removal means is configured to be secured within the interior by the at least one applicator means being releasably retained by the fittings, wherein the fittings are coupled to a first end and a second end of the at least one applicator means;

wherein the at least one applicator means and the at least one removal means are removable from the closure member; and wherein securing means are provided to permit the closure member to be releasably engagable with the container to close the aperture when engaged.

13. A method of applying a personal care composition from a receptacle comprising:

providing a receptacle comprising a container, a separate closure member, at least one applicator means for the application of the composition to a user, and at least one removal means for the removal of the composition from a user, wherein the container has a reservoir means for retaining a quantity of composition and an aperture in an upper portion of said container, wherein the closure member has a hollow construction and a releasably sealable lid member, wherein the interior of the closure member being configured to house the at least one applicator means and the at least one removal means, and the interior of the closure member being provided with fittings to releasably support at least one of said at least one applicator means and said at least one removal means, wherein the at least one removal means is configured to be secured within the interior by the at least one applicator means being releasably retained by the fittings; wherein the at least one applicator means and the at least one removal means are removable from the closure member; and wherein securing means are provided to permit the closure member to be releasably engagable with the container to close the aperture when engaged;

separating the closure member from the container;

opening the lid member of the closure member and extracting at least one applicator and at least one removal means;

inserting the applicator through the aperture and into the reservoir to extract a quantity of composition;

using the applicator means to apply the composition to a body part of the user;

subsequently the removal means to remove the composition from the user;

replacing the at least one removal means and the at least one applicator means in the interior of the closure member and resealing the lid member; and engaging the closure member with the container to close the aperture.

* * * * *